US010286283B2

(12) United States Patent
Kent

(10) Patent No.: US 10,286,283 B2
(45) Date of Patent: May 14, 2019

(54) GOLF SWING TRAINING AID

(71) Applicant: Jessica Kent, Bellevue, WA (US)

(72) Inventor: Jessica Kent, Bellevue, WA (US)

(73) Assignee: Jessica Kent, Bellevue, WA (US)

( * ) Notice: Subject to any disclaimer, the term of this patent is extended or adjusted under 35 U.S.C. 154(b) by 0 days.

(21) Appl. No.: 15/819,681

(22) Filed: Nov. 21, 2017

(65) Prior Publication Data

US 2018/0140924 A1 May 24, 2018

Related U.S. Application Data

(60) Provisional application No. 62/497,556, filed on Nov. 21, 2016.

(51) Int. Cl.
*A63B 69/36* (2006.01)

(52) U.S. Cl.
CPC ..... *A63B 69/36* (2013.01); *A63B 69/3623* (2013.01); *A63B 69/3694* (2013.01); *A63B 2069/3629* (2013.01); *A63B 2225/09* (2013.01); *A63B 2225/093* (2013.01)

(58) Field of Classification Search
USPC ..... 473/218, 219, 220, 257, 258, 261–265, 473/267, 268, 270, 272
See application file for complete search history.

(56) References Cited

U.S. PATENT DOCUMENTS 1,604,118 A 10/1926 Glancey
1,936,143 A 11/1933 Shea
2,445,839 A 7/1948 Miller
2,611,610 A 9/1952 Hara
2,626,151 A 1/1953 Jenks
2,690,911 A 10/1954 Newgren
3,243,186 A 3/1966 Johnson
3,326,558 A 6/1967 Eaton, Jr.
3,397,892 A 8/1968 Stahl
3,415,524 A 12/1968 Vickers
3,770,280 A 11/1973 Stratus
4,302,014 A 11/1981 Shull
4,513,972 A 4/1985 Empie
4,659,084 A 4/1987 Vuick
4,762,325 A * 8/1988 McCleery ..... A63B 69/3608 2/209.13
4,796,892 A * 1/1989 Doerrfeld ..... A63B 69/36 473/268
5,039,105 A 8/1991 Ro
5,211,400 A * 5/1993 Hall ..... A63B 69/3676 473/268
5,303,926 A 4/1994 Owens
5,375,844 A * 12/1994 Waud ..... A63B 69/3623 473/268
5,439,226 A 8/1995 Luedtke
6,939,245 B1 * 9/2005 Mullarkey ..... A42B 1/24 362/191

(Continued)

*Primary Examiner* — Nini F Legesse

(57) ABSTRACT

A golf training apparatus includes an elongated member having opposite first and second ends. A base is coupled to the first end of the elongated member; and the base includes an end portion to secure the apparatus in a stationary position so that the elongated member extends upward from the base. A top piece is coupled to the second end of the elongated member, and the top piece includes a sight through which a golfer may view a golf ball positioned near the base.

6 Claims, 7 Drawing Sheets

(56) References Cited

U.S. PATENT DOCUMENTS

| | | | | |
|---|---|---|---|---|
| 7,029,401 | B1 * | 4/2006 | Sowerwine | A63B 69/3632 473/257 |
| 7,150,683 | B2 | 12/2006 | Bender | |
| 7,485,053 | B2 * | 2/2009 | Nally | A63B 67/045 473/494 |
| 7,568,979 | B2 | 8/2009 | Arnold, Jr. | |
| 7,815,518 | B2 | 10/2010 | Doyle | |
| 8,206,235 | B1 * | 6/2012 | Sardo | A63B 69/3623 473/257 |
| D772,997 | S | 11/2016 | Stassi, Jr. | |
| 2009/0118026 | A1 | 5/2009 | Arnold, Jr. | |
| 2013/0040762 | A1 * | 2/2013 | Swingle | A63B 63/00 473/422 |

* cited by examiner

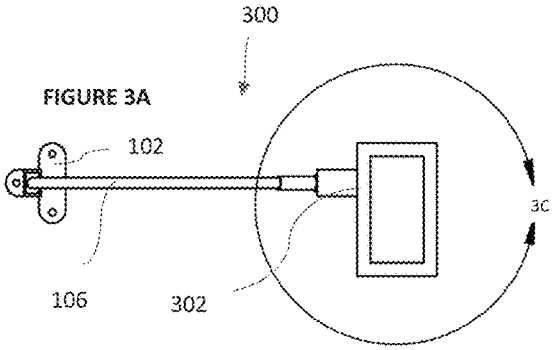
FIGURE 3A
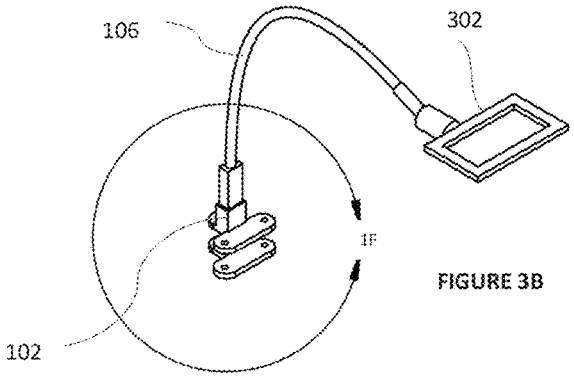
FIGURE 3B
FIGURE 3C
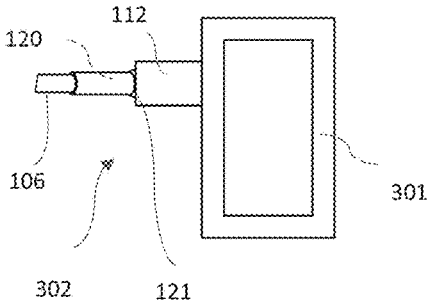
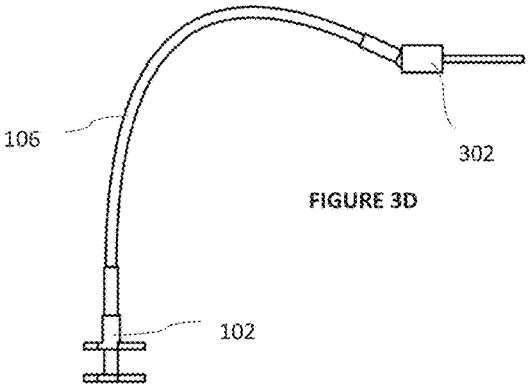
FIGURE 3D
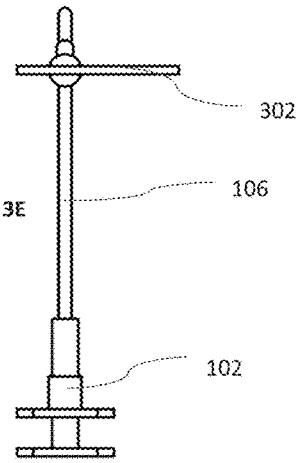
FIGURE 3E

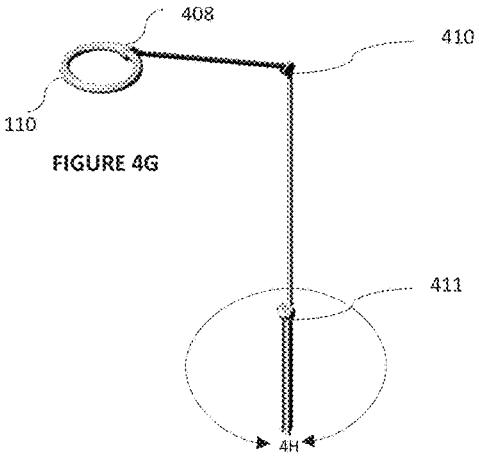
FIGURE 4G
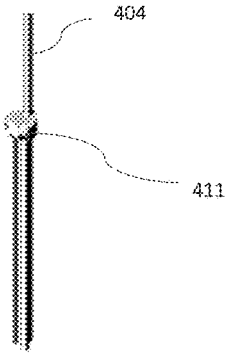
FIGURE 4H
FIGURE 4I
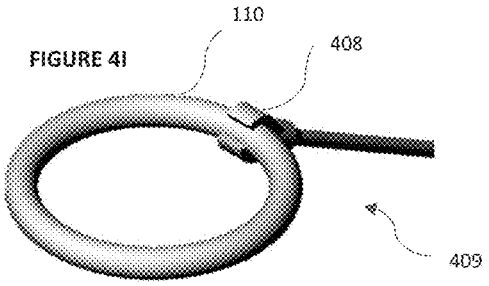
FIGURE 4J
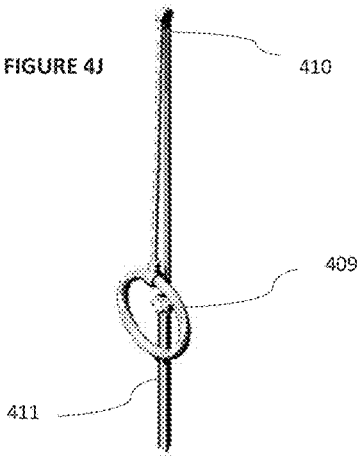

GOLF SWING TRAINING AID

CROSS-REFERENCE TO RELATED APPLICATION(S)

This application claims the benefit of U.S. Provisional Patent Application No. U.S. 62/497,556, filed Nov. 21, 2016.

BACKGROUND

There are many golf training aids that exist. Some devices that have been disclosed attempt to keep a golfer's head in a consistent position while swinging a golf club such as the following patents: Doyle, U.S. Pat. No. 7,815,518; Shull, U.S. Pat. No. 4,302,014; Arnold Jr., U.S. Pat. No. 7,568,979; Straus, U.S. Pat. No. 3,770,280; Empie, U.S. Pat. No. 4,513,972; Rikuo Hara James, U.S. Pat. No. 2,611,610; Leudtke, U.S. Pat. No. 5,439,226; Harold, U.S. Pat. No. 3,326,558; Glancey, U.S. Pat. No. 1,604,118; Newgren, U.S. Pat. No. 2,690,911; Troutman, U.S. Pat. No. 2,626,151; Stassi, U.S. D772,997; Arnold US20090118026; Shea, U.S. Pat. No. 1,936,143; Owens, U.S. Pat. No. 5,303,926; Abraham, U.S. Pat. No. 5,039,105; Benolt LLC, U.S. Pat. No. 7,150,683; Stahl, U.S. Pat. No. 3,397,892; Johnson U.S. Pat. No. 3,243,186; Randall, U.S. Pat. No. 2,445,839; Vickers U.S. Pat. No. 3,415,524; Vuick, U.S. Pat. No. 4,659,084. Some of problems with these prior systems are that the apparatus directly comes in contact with the golfer's head to restrict movement or lateral movement of the head. Because of the acceleration and powerful force created by the momentum during a golf swing, any apparatus connecting directly to the head to restrict head movement poses as a potential risk by causing a head or neck injury during the golf swing. Of course, there are other problems of prior systems.

Overall, many golfers of all levels, ranging from beginner to professional golfer want to improve one's golf skills because it leads to a lower handicap or number of golf shots taken to complete a golf round. To improve one's golf skills, many golfers seek out training aids designed to help them during practice to develop proper techniques and ingrain proper muscle memory of the swing, therefore improving their golf skills. In response to the desire to improve one's skills, a number of golf training aids have been developed which are commonly used by golfers. There are many driving ranges and other practice facilities to provide golfers a location to use such training aids as they work on improving their golf skills. Many golfers prefer to transport a training aid, in a convenient manner, by placing it in a conventional golf club bag and transporting the training aid, along with their golf clubs, to their desired golf training facility.

While practicing, golfers want to maintain a relatively steady head position and spine angle while completing the golf swing. A commonly recognized tendency in a golfer is to lift their head, tilt their head, or have a lot of lateral movement of the head and body while taking their golf swing. This is due to the natural desire for the golfer to remove eye contact from the golf ball to see the position of their club, to look too quickly up to see where the golf ball was hit, shift their weight to their back foot on impact to scoop the ball off the ground, as well as laterally move the upper body as they shift their weight to their back foot during the backswing. If the golfer removes eye contact with the ball prior to the golf club head coming into contact with the golf ball, the result is inconsistent and inaccurate golf ball flight will often occur. In addition, movement of the head may cause injuries related to the spine, knees, neck, hips and back due to repetitive out of sequence momentum of the hips and upper body during the golf club swing. If a steady head position and eye contact with the ball is maintained, up until the golf club head comes in contact with the golf ball, then the spine, arms, head, or neck will be in more sequence, which may help reduce injuries related to the spine, knees, neck, hips and/or back.

BRIEF DESCRIPTION OF THE DRAWINGS

FIG. 3A is a top view of an alternative golf training aid.

FIG. 3B is a front isometric view of the golf training aid.

FIG. 3C is an enlarged view of the section 3C shown in FIG. 3A.

FIG. 3D is a side view of the golf training aid.

FIG. 3E is a front view of the golf training aid.

FIG. 4G is front isometric view of the golf training aid in FIG. 4A.

FIG. 4H is an enlarged view of the section 4H shown in FIG. 4G.

FIG. 4I is an enlarged view of the section 4I shown in FIG. 4A.

FIG. 4J is a front isometric view of the golf training aid in FIG. 4A.

DETAILED DESCRIPTION

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but no other embodiments.

Described below is an apparatus that relates generally to golf swing training aids, in particular training aids which allow the user, also referred to as the golfer, to learn to reduce head movement while making a golf swing or golf stroke with any type of golf club which may also help promote the golfer to maintain a consistent spine angle throughout the golf swing and improve golf swing sequence of upper and lower body movement. By improving on one or multiple of the listed techniques, golfers can experience improved accuracy, consistency, and/or possible reduction of golf related injuries.

Figure 1A:
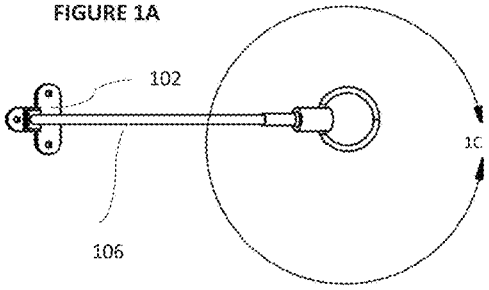
FIG. 1A is a top view of a golf training aid.

FIG. 1A is a diagram illustrating one embodiment of a golf training aid 100, which includes a base 102 and top piece 104 connected together by a semi-flexible shaft 106. The top piece 104, shown in greater detail in FIG. 1C, includes a ring-shaped sight 110 connected to one end of the shaft 106 by a connector 112, having a shaft connector 120, and ball joint 121. The connector 112 with sight 110 can be removably detached from ball joint 121 which connects to connector 120 to permit one of many potential top pieces to be attached to the training aid 100. The shaft 106 is approximately 21 inches to 24 inches long. The length of the shaft 106 is long enough to be bent and arc over the ball so that the device can be out of the swing path of the golfer and is long enough so that the top piece 104 rests about knee height to the golfer as shown in FIG. 2. The shaft 106 materials may include semi-flexible plastic such as ABS plastic and/or a lightweight aluminum shaft 106 to provide a bendable or bendable gooseneck shaft that holds the shape the user bends it to. The bendable nature of shaft 106 allows golfers to wrap, fold, and/or coil the training aid into various shapes and sizes allowing a portable size training aid that can fit in a conventional golf bag for easy transportation. The base 102, shown in greater detail in FIG. 1F, includes an adjustable recoil clamp composed of components 116 and 117 that is attached to another end of the shaft 106 by a base connector 118. Clamp component 117 can slide up and down base connector 118 to accommodate different conventional golf hitting mats (an example of which is shown in FIG. 2). Adjusting the height, position, and/or angle of the training aid device can be configured by applying pressure to the top piece 104 and/or the shaft 106.

Figure 1B:
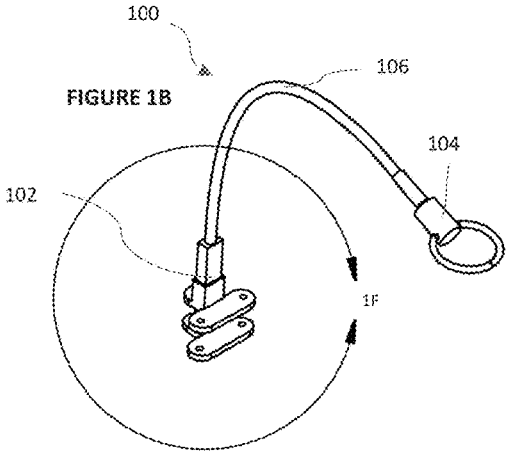
FIG. 1B is a front isometric view of the golf training aid.
Figure 1C:
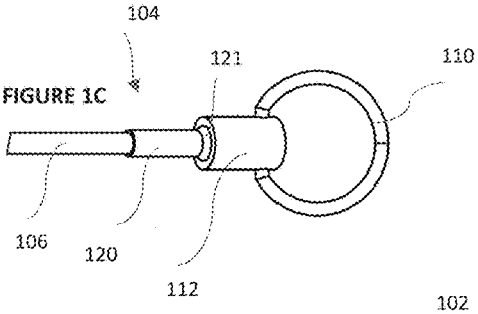
FIG. 1C is an enlarged view of the section 1C shown in FIG. 1A.
Figure 1D:
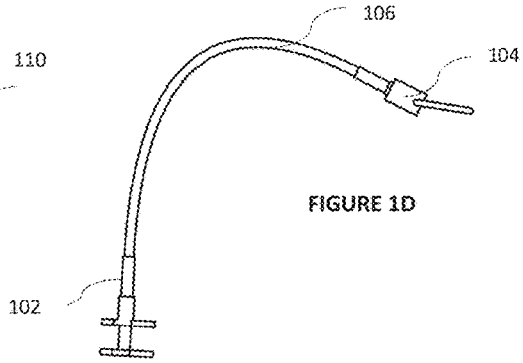
FIG. 1D is a side view of the golf training aid.
Figure 1E:
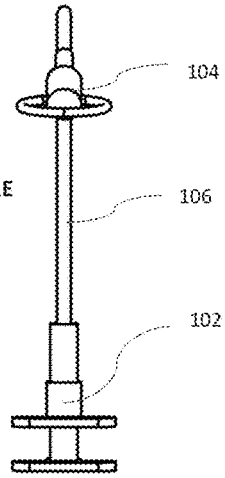
FIG. 1E is a front view of the golf training aid.

FIGS. 1B, 1D, and 1E are alternative views of the golf training aid 100 in FIG. 1A.

FIG. 1C is an enlargement of the top sight piece 104 in section 1C of FIG. 1A. FIG. 1C illustrates one of the many potential top pieces that may be attached to the training aid as the circular sight ring 110 may be detached and replaced with different interchangeable top pieces, such as the one illustrated in FIG. 7 and FIG. 3C 302, through detachment of connector 112 from ball joint 121. The top piece 104 may be comprised of a ring sight made of rubber that is connected to the semi-flexible shaft 106 by a hard-durable plastic connector 112 that surrounds a ¼ inch to ½ inch ball joint 121 allowing the ring 110 to be rotated up, down, left, and/or right (and retained in that position) to accommodate all golfers. The diameter of a cross section of ring 110 is approximately ¼ inch but may vary. The diameter of the opening of the sight ring 110 may range from 2.5 inches to 4.5 inches wide. A range of ring 110 dimensions will be used depending on the type of golf shot. For example, a smaller sight ring 110 may be used when putting due to the relatively short and small nature of the swing as compared to a swing with a long iron which has relatively longer, larger swing movements and thus a larger sight ring 100 may be used.

Figure 1F:
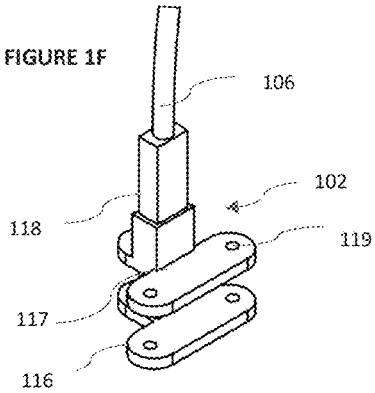
FIG. 1F is an enlarged view of the section 1F shown in FIG. 1B.
Figure 2:
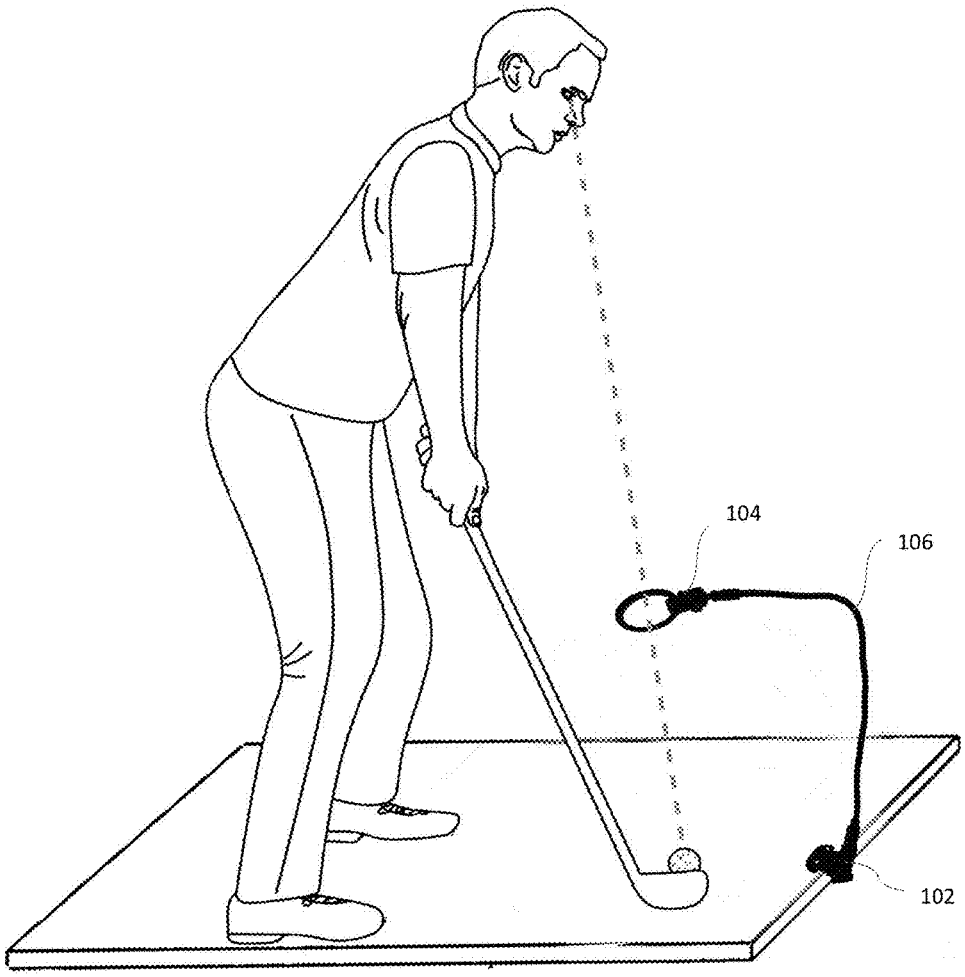
FIG. 2 is an isometric view showing the golf training aid in use by a golfer.

FIG. 1F is an enlargement of the section 1F in FIG. 1B illustrating one embodiment of the golf training aid base 102. FIG. 1F depicts the adjustable base 102 of the training aid to accommodate different thickness of conventional golf hitting mats. The training aid can be held upright (as shown in FIG. 2) by placing the hitting mat, common in many driving ranges between the clamp's components 116 and 117. The base has an adjustable sliding clamp mechanism to secure the training aid base to the mat, with a manual, spring-loaded locking mechanism (not shown) to releasably hold the clamp in a given position. The clamp components 116 and 117 used to attach the training aid to the golf mat can be about 3 inches in length and about ¾ to an inch in width, and may be composed of a durable plastic. Component 117 may be slid up and down connector 118, allowing components 116 and 117 to spread apart from each other between approximately 0 inches to 4 inches to securely fasten to conventional golf hitting mats of variable thickness and/or thinness. Additionally, when hitting shots off of natural ground, when there is no conventional golf hitting mat used, penetrating tees, stakes, or other objects (not shown) may be inserted into the ground through the training aid's hole(s) 119, which will hold the training aid upright in a given position. Various embodiments of base 102, may or may not have the hole(s) 119.

FIG. 2 is a diagram illustrating an embodiment of one of many ways to use the golf training aid. For example, as depicted a golfer can attach the training aid upright to a conventional golf hitting mat through securing base 102 to an edge of the mat, shown in greater detail FIG. 1F. The dotted line represents the eye line gaze of the golfer who looks through the top open piece 104 of the device, shown in greater detail FIG. 1C. The ball when the golfer takes their stance is centered in the top piece 104. When a golfer takes their swing, the ball must stay relatively centered in the top piece 104 to help promote a golfer to retain a steady head and consistent spine angle during the swing. If an alternative shape is used for the sight piece such as those shown in FIG. 7 701 and FIG. 3C 302, the ball may be placed closer to the golfer's front foot due to the necessary head stabilization needed based on the type of golf swing (drive, chip, putt, etc.). In this case, the golfer may place the ball inside the sight piece 701 or 302 in line with connector 112. As shown, a connector 408 is an open C-shaped clamp holding an elongated edge of rectangular sight 700, where the connector clamp is positioned not in a middle of the edge, but offset a bit. The C-shaped clamp allows the sight 700 to be slide axially through the clamp to different positions.

FIG. 3A is a diagram illustrating another embodiment of the training aid with a rectangular top sight piece 302 that can attach to the top of the training aid device. The outline of these top sight pieces can be, but not limited to: a circle, oval, square, rectangle, trapezoid, a straight line, arc, semi-circle. These pieces provide the shape that golfers look through to see the ball as shown by the dotted line representing the golfers eye line gaze in FIG. 2. Overall, during the swing of the golf club, a golfer's head is to remain relatively stable throughout the swing, but different swing types such as driving, chipping, and putting may need different shaped top pieces that will accommodate the different weight shift movements of the swing. For example, the rectangular top sight piece 302 shown in FIG. 3A is attached off-centered to the training aid. When the golfer places the ball inside the rectangular sight top piece 302, the ball may be placed slightly closer to their front foot, in line with the connector 112 when they take their stance to hit the ball. The rectangular sight top piece 302 provides the necessary guide to accommodate a swing such as those with the driver that may require a modified head position during the backswing. For example, when swinging a longer club such as the driver, slightly more head movement is acceptable during the backswing to accommodate the wider golf stance golfers often use with the driver compared to shorter wedge irons. Additionally, top pieces 104, 302, and 701 may or may not have lines or other indicia (not shown) on the top surface to provide a reference for aim as well as to help visually guide golfers on the correct position to place the ball correctly within the sight top piece.

FIGS. 3B, 3D, and 3E provide alternative views of the training aid device 300 shown in FIG. 3A.

FIG. 3C is an enlargement of section 3C in FIG. 3A. The rectangular top piece 302 may be interchanged with top piece 104. The rectangular top piece can be made of but not limited to plastic, silicon, and/or rubber material, ranges between 3 to 5.5 inches in length and about 2 to 3.5 inches wide.

Figure 4A:
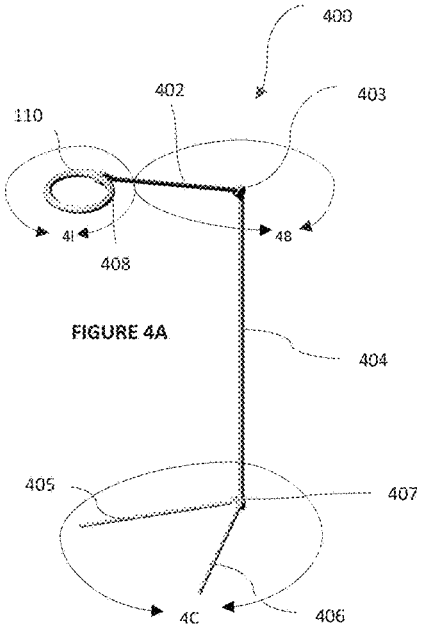
FIG. 4A is a front isometric view of an additional alternative golf training aid.

FIG. 4A is a diagram illustrating an alternative embodiment of the training aid 400 with one of many potential top sight pieces such as 110 and 700 that can be attached to the training aid. The training aid consists of an attachable top piece ring 410 adhered or secured to the training aid device via connector 408, a collapsible and expandable base 411, and shafts 402 and 404. Adjusting the height, position, and/or angle of the training aid device can be configured by applying pressure to rotate the top-piece 110 and/or by applying pressure to the shaft 402 shown in greater detail in FIG. 4B.

Figure 4B:
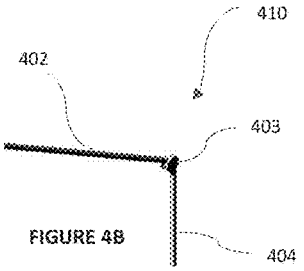
FIG. 4B is an enlarged view of the section 4B shown in FIG. 4A.

FIG. 4B is an enlargement of section 4B in FIG. 4A. The body of the golf training aid consists of an adjustable shaft 402, and stationary shaft 404 joined together by a connector 403 which includes a locking mechanism (not shown) to hold the shafts in a given position or angle relative to each other. Connector 403 allows the shaft 402 to rotate or pivot up and down relative to shaft 404 (thereby changing the angle between the shafts), to thereby accommodate the different height golfers, allowing each golfer to have a similar depth perception view of the golf ball through the sight piece ring 110. Shaft 402 rotates or pivots up/down so as to position the top sight piece ring 110 approximately knee height of the golfer when they take their stance to hit the golf ball. The length of shaft 404 can range between 20-25 inches and shaft 402 can range between 9 inches to 12 inches.

Figure 4C:
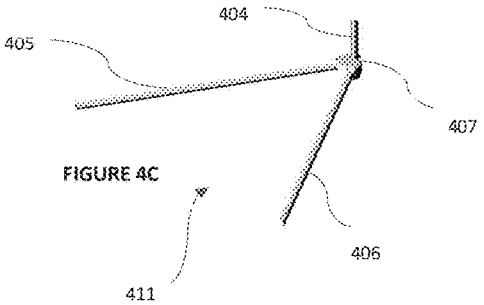
FIG. 4C is an enlarged view of the section 4C shown in FIG. 4A.

FIG. 4C is an enlargement of section 4C in FIG. 4A illustrating one of the many positions of the adjustable base 411 of the training aid 400. The training aid 400 can be held upright (as shown in FIG. 4) by extending and placing the base legs 405 and 406 under the hitting mat or by letting the base 411 stand upright on the ground with the legs 405 and 406 parallel to the ground as shown in FIG. 4C. The device's legs 405 and 406 range in length from 3 inches to 6 inches and are not thick (no thicker than a ¼ of an inch) as thick legs would create an uneven mat surface, thus disrupting a golfer's lie angle when placed under a conventional hitting mat. To increase portability of the training aid, material for legs 405 and 406, and shaft 404 and 402 can include but not limited to solid rod or hollow pipe made of lightweight hard-durable plastic, thin metal, graphite, aluminum, etc. Additionally, the training aid's base 411 can be adjusted so that the base legs 405 and 406 and partially shaft 404 can penetrate into the ground by folding the legs 405 and 406 together to form a stick like shape that can be pushed into the ground to hold the training aid upright as modeled in FIG. 4H. To slide the legs together, a user applies upward force on connector 407 to slide connector 407 up the shaft 404. Connector 407 has a locking mechanism (not shown), locking the legs into a given position. Legs 405 and 406 may be pivoted about one end relative to the connector 407.

Figure 4D:
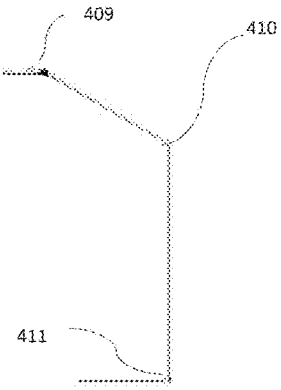
FIG. 4D is a side view of the golf training aid in FIG. 4A.
Figure 4E:
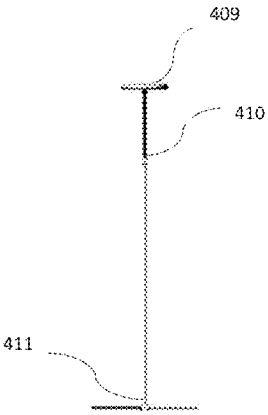
FIG. 4E is a front view of the golf training aid in FIG. 4A.
Figure 4F:
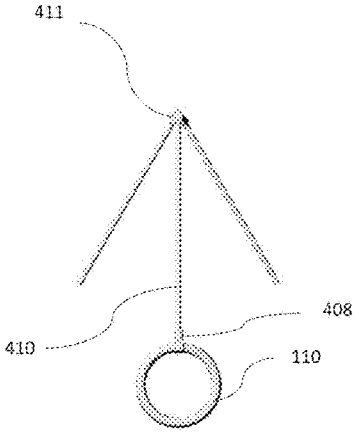
FIG. 4F is a top view of the golf training aid in FIG. 4A.

FIGS. 4D, 4E, and 4F are additional views of the golf training aid 400 as shown in FIG. 4A. In another embodiment, some or all of the shafts or legs 402, 404, 405 and/or 406 may be formed of nested and telescoping lengths of pipe.

FIG. 4G is a diagram illustrating the training aid 400 as shown in FIG. 4A but with the base 411 in a folded, collapsed position. Since users may practice golf on conventional golf hitting mats as well as on natural ground without golf hitting mats, the adjustable base accommodates both usages. When the base is collapsed as modeled in FIG. 4G, the golfer can penetrate the base 411 into the ground to hold the training aid relatively secure upright as they swing.

FIG. 4H is an enlargement of the section 4H in FIG. 4G illustrating one of the many positions of the device. This diagram shows the position of the device's legs fully closed together. Users can apply downward pressure on connector 407 to slide the legs 405 and 406 downward relative to the shaft 404, and pivot the legs into a flat position, perpendicular relative to the shaft 404, as depicted in FIG. 4C. When the device's base 411 is resting in the position shown in FIG. 4C, users can apply upward force on the connector 407 to pull the legs up the shaft 404 and pivot the legs in and closer together as illustrated in FIG. 4H. In the position modeled in FIG. 4H, or in any position between the positions show in FIG. 4C and FIG. 4H, the golfer may penetrate the legs 405 and 406 and part of shaft 404 into the ground to hold the training upright as they swing. For example, other positions not shown, users may also arrange the legs 405 and 406, and shaft 404 to form a resemblance of a tripod shape to hold the device upright, with the bottom end of the shaft 404 effectively forming a third leg. Component 407 consists of a locking mechanism not shown that locks the legs into place. The adjustability of the base allows users to use the device when swinging in various conditions such as on grass, sand, sloping/uneven grounds, traditional hitting mats, etc. The collapsible nature of the golf training aid allows the base 411 to be out of the swing path of the golf club when used on natural ground and can increase ease of portability of device 400.

FIG. 4I is a diagram illustration one embodiment of the many top sight pieces that may be attached to one of the many embodiments of the training aid device such as devices 400, 300, 100. The sight ring 110 can be rotated up and down to accommodate all golfers. User may remove sight ring 110 from C-shaped connector 408 and replace ring 110 with a different top piece shape such as the rectangular top sight shape piece 700.

FIG. 4J is a diagram illustrating one of the numerous ways the training aid 400 can be positioned and/or folded. The size and compactness of the device 400 can be placed in a conventional golf carrying bag and allows for easy transportation to and from various locations.

Figure 5:
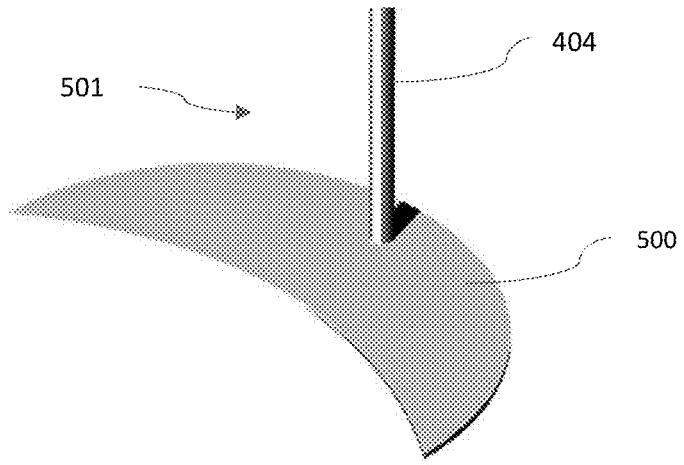
FIG. 5 is a front isometric view of an alternative base of the golf training aid.

FIG. 5 illustrates one of many embodiments of bases the training aid device 400, 300, and/or 100 can have. In FIG. 5, a base 501 consist of a crescent-shaped base plate 500 that can be slid under a traditional hitting mat to securely hold the device upright. The thinness of the base plate 500 is approximately 1/10 of an inch to 1/4 inch of an inch which can help keep the golfer's lie of the mat's surface undisrupted when the base plate 500 is slid under a conventional hitting mat. Additionally, the crescent shape of base plate 500 allows the area where the golfer places the ball on the mat undisrupted when base plate 500 is placed under the mat. The training aid base plate 500 may also be placed on top of the ground to stand freely on its own. If necessary, golfers can place objects of weight on top of the base plate 500 to hold the base upright if desiring more stability. The different bases as shown in FIG. 1F, FIG. 4C, FIG. 4H and FIG. 6 may or may not be interchangeable, but are used as examples of different bases that may be used for the golf training aid and can be used in any combination with the different components in training aid's 400, 300, and 100.

Figure 6:
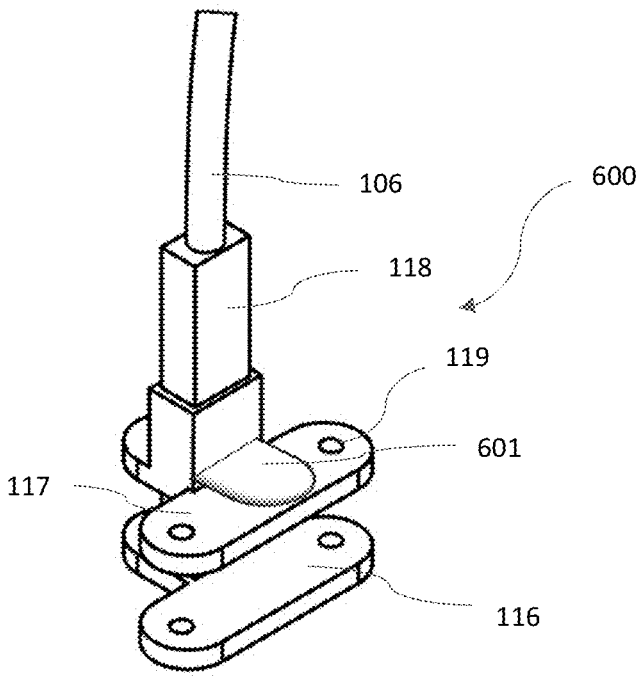
FIG. 6 is a front isometric view of an alternative base of the golf training aid.

FIG. 6 illustrates one of many embodiments of bases the training aid device can have. Base 600 consists of similar components as base 102 which includes a connector 118, clamp components 116 and 117, and holes 119. However, base 102 is a spring loading recoil mechanism whereas base 600 does not have a spring loading recoil mechanism. Base 600 includes a locking mechanism 601 that is attached to the top piece of the clamp component 117. Users can lift the locking mechanism 601 upwards to unlock the mechanism, allowing clamp 117 to freely slide up and down the connector 118. To accommodate different range of golf mat thicknesses, users can lift the clamp 117 higher or lower depending on the thickness of the mat which generally range from 1/2 in to 3 inches in thickness. Once the mat is placed between clamp components 116 and 117, a user applies downward force on 117 and/or 119 so that the distance between component 116 and 117 is equivalent to the thickness of the golf mat. To lock the mechanism into place, users can apply additional downward pressure to mechanism 601 and snap it securely into the locking mechanism (not shown) to hold the base in a given position.

Figure 7:
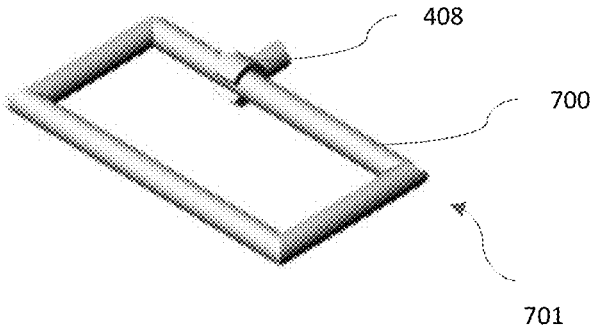
FIG. 7 is a front isometric view of an alternative top piece of the golf training aid.

FIG. 7 illustrates one of many different, but not limited to, embodiments of the top pieces that users look through during the swing. These top pieces such as rectangle 700 and ring 110 may be snapped into connector 408 and held into place. Once top pieces are securely held by connector 408, the top pieces 110 or 700 can be rotated up and down if desired by the user to adjust the view angle. The rectangular top piece 700 can be made of but not limited to plastic, silicon, and/or rubber material and range between 3 to 5.5 inches in length and about 2 to 3.5 inches wide.

Other embodiments of the device may or may not have top pieces that the user can interchange, and may include different shape top pieces other than the shapes of top pieces 110 and 700.

Those skilled in the art will appreciate that the components illustrated in FIGS. 1-7 described above, and may be altered in a variety of ways.

Various examples of the invention will now be described. The following description provides certain specific details for a thorough understanding and enabling description of these examples. One skilled in the relevant technology will understand, however, that the invention may be practiced without many of these details. Likewise, one skilled in the relevant technology will also understand that the invention may include many other obvious features not described in detail herein. Additionally, some well-known structures or functions may not be shown or described in detail below, to avoid unnecessarily obscuring the relevant descriptions of the various examples.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

The training aid can be used to improve a golfer's swing technique and muscle memory by helping the golfer keep a steady head during the swing which can lead to increasing accuracy and lower scores. The training aid reduces head movement in a golfer's swing as the training aid helps golfers focus their eyes on the ball and provides the golfer instant visual feedback about the relative position of the head compared to the ball during one's swing. One embodiment to use the device is shown in FIG. 2 (additional embodiments can be seen in the remaining Figures, as golfers take their golf stance they place their eye gaze through the opening of the top piece such as but not limited to pieces 110, 301, 700 of the device to see the ball. As one swings the club they must be able to see the golf ball through the device's opening depicted by the eye gaze line in FIG. 2. If a golfer's head has too much lateral or vertical movement, the ball may not be visible through the opening shaped top piece (For example, the circle shape 110 on the top of the training aid in FIG. 1C and additional embodiments in FIGS. 3C, 4I, and 7). When a golfer retains eye contact with the ball within the opening circle piece or desired shaped piece up until the club head makes impact with the golf ball, this can help keep a steady head during the swing. The different size and/or shape top pieces that can attach to the training aid can be used to accommodate different requirements of lateral movement in the golf swing such as a swing with a driver versus a putting stroke. The size of the top piece golfers look through to see the ball, depicted in FIGS. 1C, 3C, 4I, and 7 is constructed to be widen enough to allow for a proper weight shift during the swing, but small enough to help prevent the following, but not limited to: too much lateral shift of upper body, unnecessary movement of the head, unnecessary knee twists/bends, as well as improper spine angle changes that happen during the swing. A reduction in unnecessary movement in the swing can lead to improved consistency and accuracy of golf ball flight. In addition, due to the anatomy of the human body, maintaining a steady head can help keep a golfer's spine angle consistent during the swing because it may help synchronize the swing motions timing relative to the arms, hips, spine, etc. By properly timing the synchronization of swing moments, this may help reduce injuries such as hip, back, knee, and neck problems that many golfers face which can be due to incorrect repetitive and/or forceful motion of the swing.

Each golfer differs in size, height, and preference of how they take their golf stance. Thus, the disclosed technology can be adjusted to accommodate all golf club lengths and types as well as all heights and size people. The disclosed training aid is designed to be out of the way of a golf club's swing path and if the training aid is hit by the golfer during a swing materials will be used to minimize damage to the club as well as the golfer.

Golf is an all-year long, all weather sport for some people. Thus, the device has been made to stand up to multiple weather conditions such as wind, rain, sun, snow, etc. and can be used on driving ranges with mats or used in natural ground for driving, chipping, putting, and/or pitch shots. The device is conveniently sized to fit in a standard golf bag for easy transportation.

Repetition of fundamental techniques of the swing learned such as keeping a steady head and/or maintained spine angle can be lost when not practicing the skill(s). Thus, the training can be found useful to beginner to professional level golfers.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Although the subject matter has been described in language specific to structural features and/or methodological acts, it is to be understood that the subject matter defined in the appended claims is not necessarily limited to the specific features or acts described above. Specific embodiments and implementations have been described herein for purposes of illustration, but various modifications can be made without deviating from the scope of the embodiments and implementations. The specific features and acts described above are disclosed as example forms of implementing the claims that follow. Accordingly, the embodiments and implementations are not limited except as by the appended claims.

Any patents, patent applications, and other references noted above are incorporated herein by reference. Aspects can be modified, if necessary, to employ the systems, functions, and concepts of the various references described above to provide yet further implementations. If statements or subject matter in a document incorporated by reference conflicts with statements or subject matter of this application, then this application shall control.

I claim:

1. A portable golf training apparatus, comprising:

an elongated pole having opposite first and second ends;

a base coupled to the first end of the elongated pole; and wherein the base includes an end portion to secure the apparatus in a stationary position so that a semi-flexible and bendable elongated member extends upward from the base; and a top piece coupled to the second end of the elongated pole;

wherein the top piece includes an open sight through which a golfer maintains a view of a golf ball positioned near the base as the golfer performs a golf club swing, wherein the base includes a mechanism to manually clamp the base to an edge of a golf driving range mat, wherein the end portion of the base includes at least one hole sized to accommodate a separate spike inserted therethrough, wherein the spike has a length and strength to be driven into a grassy lawn, wherein the sight is a circular ring having an opening with a diameter from 3 inches to 4.5 inches wide, and wherein the semi-flexible and bendable elongated member is approximately 21 inches to 24 inches long.

2. The golf training apparatus of claim 1 wherein the top piece has a releasable clamp to releasably retain differing sights, whereby different sights, each having differing internal areas.

3. The golf training apparatus of claim 1 wherein the sight is a removable circular or rectilinear ring.

4. A golf training apparatus, comprising:

a semi-flexible elongated member having opposite first and second ends;

a base coupled to the first end of the semi-flexible elongated member; and wherein the base includes an end portion to secure the apparatus in a stationary position so that the semi-flexible elongated member extends upward from the base; and a top piece releasably coupled to the second end of the semi-flexible elongated member;

wherein the top piece includes a sight through which a golfer may view a golf ball positioned near the base, wherein the base includes a mechanism to manually clamp the base to an edge of a golf driving range mat, wherein the end portion of the base includes at least one hole sized to accommodate a separate spike inserted therethrough, wherein the spike has a length and strength to be driven into a grassy lawn, wherein the sight is a circular ring having an opening with a diameter from 3 inches to 4.5 inches wide, and wherein the semi-flexible and bendable elongated member is approximately 21 inches to 24 inches long.

5. A golf training aid, comprising:

a base for securing the golf training aid to natural ground for a golf ball hitting mat;

an adjustable, semi-flexible and bendable member fastened to the base and extending upwards to a connector;

wherein the connector is attachable to multiple golf ball viewing pieces;

wherein each of the golf ball viewing pieces are rotatable relative to the semi-flexible member to thereby accommodate different types of golf shots, different heights of golfers, and/or different golf stances of golfers; and wherein the golf training aid is formed of materials to permit the golf training aid to be folded to store the golf training aid in a conventional golf bag:

wherein the base includes a mechanism to manually clamp the base to an edge of a golf driving range mat, wherein the end portion of the base includes at least one hole sized to accommodate a separate spike inserted therethrough, wherein the spike has a length and strength to be driven into a grassy lawn, wherein the golf viewing piece includes a ring having an opening with a diameter from 3 inches to 4 5 inches wide, and wherein the semi-flexible and bendable elongated member is approximately 21 inches to 24 inches long.

6. The golf training aid of claim 5 wherein at least one of the golf ball viewing pieces includes one or more lines to visually help a golfer align a golf shot and/or align the golf ball correctly within a central opening of the one or more golf ball viewing pieces.

* * * * *